United States Patent [19]

Rasmussen

[11] 4,127,349

[45] Nov. 28, 1978

[54] CONCRETE PAVING STONE AND METHOD OF MANUFACTURING SAME

[75] Inventor: Knud A. Rasmussen, Roskilde, Denmark

[73] Assignee: SF-Sten A/S, Roskilde, Denmark

[21] Appl. No.: 789,427

[22] Filed: Apr. 21, 1977

[30] Foreign Application Priority Data

Apr. 29, 1976 [DK] Denmark ..... 1911/76

[51] Int. Cl.[2] ..... E01C 5/08

[52] U.S. Cl. ..... 404/45; 52/659

[58] Field of Search ..... 404/48, 34, 38, 42, 404/37, 39, 70; 52/659

[56] References Cited

U.S. PATENT DOCUMENTS

| | | | |
|---|---|---|---|
| 881,700 | 3/1908 | Miller | 404/70 X |
| 1,645,635 | 10/1927 | Wescott | 404/45 |
| 2,055,822 | 9/1936 | Holmes | 404/45 X |
| 3,041,785 | 7/1962 | MacDonald | 404/34 X |
| 3,242,832 | 3/1966 | Schnaar | 404/39 |
| 3,557,669 | 1/1971 | Fenton | 404/45 X |
| 3,808,085 | 4/1974 | Givens | 52/659 X |
| 3,891,340 | 6/1975 | Bolli | 404/34 X |
| 3,922,105 | 11/1975 | Bolli | 404/34 |

*Primary Examiner*—Nile C. Byers, Jr.

*Attorney, Agent, or Firm*—Burgess, Ryan and Wayne

[57] ABSTRACT

A concrete paving stone having single flags held together with a number of concrete ribs between adjacent stones such that the ribs will resist breaking during ordinary handling but will break upon the application of vibration after the paving stone is laid on a level sand bed to thereby provide a number of unconnected flags.

3 Claims, 3 Drawing Figures

CONCRETE PAVING STONE AND METHOD OF MANUFACTURING SAME

BACKGROUND OF THE INVENTION

This invention relates to a concrete paving-stone consisting of a number of single flags which are concreted together, the concreting together of which is dimensioned for breaking during the paving, and a method of manufacturing such paving-stone.

To facilitate the work of laying paving-stones and to increase, simultaneously the speed of laying, experiments have been made with the laying of flags consisting of concreted together single stones. Between the adjacent single stones there is an unbroken connection, which is weakened by having a reduced thickness in proportion to the single stone. After the laying of such a stone on a levelled sand bed, the single stones are vibrated by which the connection between the single stones is broken as the concreting together breaks. After this the single stones make up a pavement, as it is known from traditional paving of single stones. The advantage of using such concreted together single stones is the easier storage and handling of these stone flags and the quick paving by means of suitable paving means. It should hereby be possible to reduce the price of a ready pavement by more than one half of the price up to now for paving with traditional stones.

However the experiments up to now regarding a manufacture of a suitable paving stone, which meets the requirements of this paving method, have not fulfilled the expectations. In the first place it is difficult at the same time to secure a concreting together, which is strong enough not to break during transport, loading and unloading or during the laying itself on the sand bed, and which is weak enough to break by vibration. It has also proved in practice that the concreting together in many cases breaks during handling, whereby the pavement-stone goes to several pieces. This means that the newly developed transport-and paving means cannot work satisfactorily, and that manual assistance is necessary. This makes the paving difficult and increases the costs of same.

To this is added that the unbroken concreting together between the single stones makes a satisfactory pressing down of stones into the sand bed difficult or impossible.

SUMMARY OF THE INVENTION

It is an object of the invention to remedy these drawbacks and to improve the result of the ready pavement both as to quality- production and working time. This is achieved when the concreting together is formed by at least one rib between adjacent single stones and the rib extends from the under side of the stone to at most the upper edge of the lateral faces of the single stones, and where at least the lower part of the rib consists of concrete with a reinforcement for increase of the tensile strength. Hereby is achieved, that the concreting together consisting of one or several ribs, keeps single stones of a pavement flag together, which can be treated very roughly during transport and the like without breaking of the rib or ribs, as the upper part of the rib, which is usually without any reinforcement, will absorb compressive strains, if any, while the lower part of the rib will be able to absorb the tensile strains, if any, on account of the special reinforcement. This means that the pavement flag is very resistant to breakage during lifts by a grab catching about two lateral edges, which way of transportation is the usual one by removal of flagstones and the like. If one or several ribs break by mishap, the reinforcement still keeps the single stones together, so that they can be treated mechanically. On the other hand breaking during vibration is easy, as the reinforcement by suitable tests is dimensioned to permit displacement and thereby breaking caused by the vibration. Finally the rib construction ensure that the single stones can be easily pressed down during the vibration, as the subsoil is not prevented from being easily distributed and pressed up between the single stones.

In a further embodiment, wherein short reinforcement materials are used, concrete and wire can be mixed in the usual mixing systems. This results in breaking being secured by the vibration while the cohesion is sufficient to keep the single stones together, if the ribs should break by mishap before the vibration.

Another aspect of this invention concerns a method for the manufacture of such a pavement stone. This method is suitable, as it can be carried out in the hitherto known systems for series production of paving stones, clinkers, flagstones and the like.

BRIEF DESCRIPTION OF THE INVENTION

The invention will be described in further details with reference to the drawings in which FIG. 1 shows a flagging in top view formed by several laid paving stones, FIG. 2 shows a section II—II of a rib and adjacent stones in FIG. 1 and FIG. 3 shows a section III—III of the slot between adjacent stones in FIG. 1.

DETAILED DESCRIPTION OF THE PREFERRED EMBODIMENT

Figure 1:
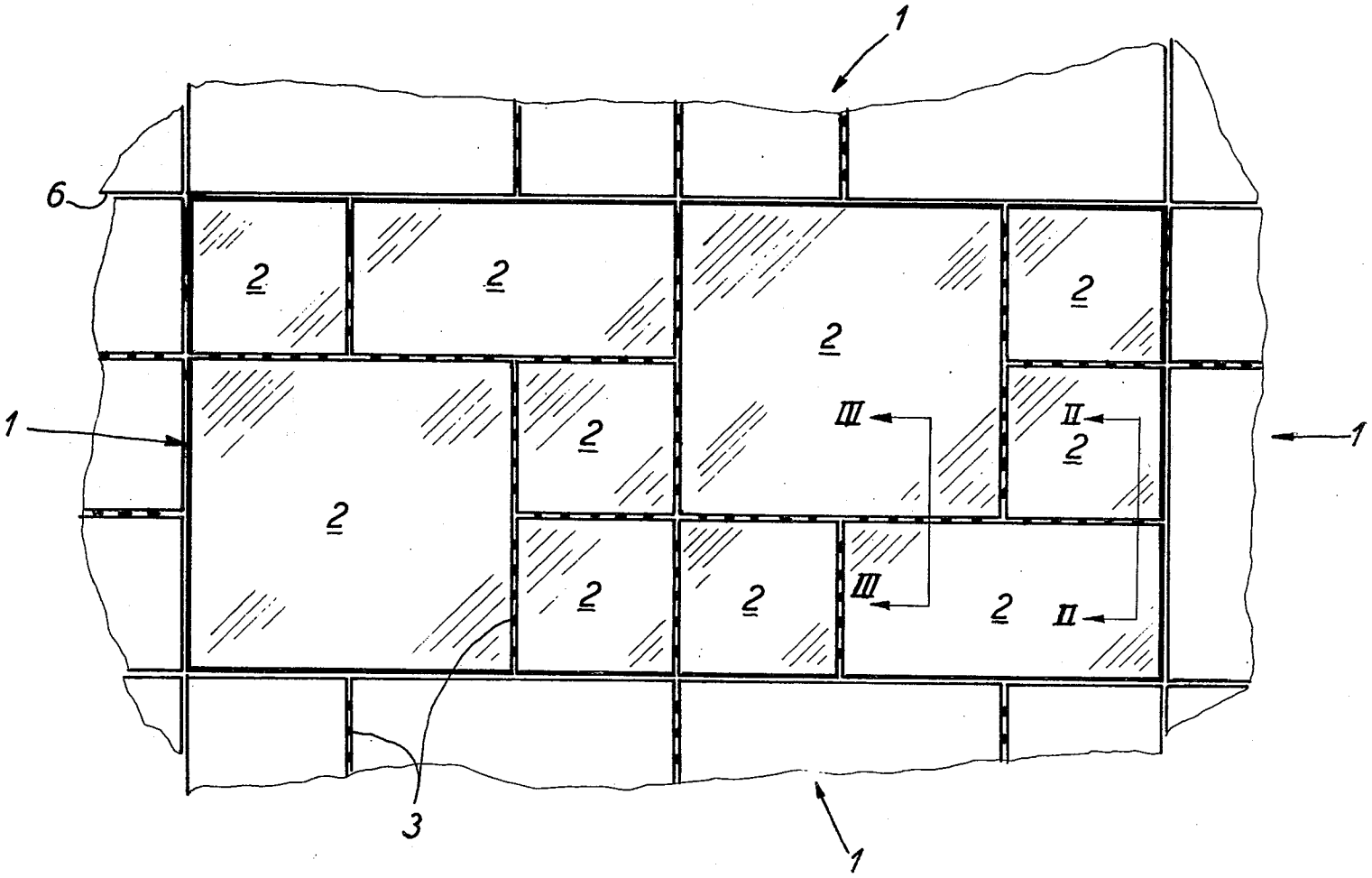

As shown in FIG. 1 a concrete paving stone 1 consists of ten rectangular single stones 2, which together form the rectangular paving stone 1. The number and the shape of the single stones may naturally vary within wide limits. To keep the stone flag 1 together ribs have been concreted between the single flags of a length corresponding to the width of the joint wanted. The rib, which is shown in side elevation in FIG. 3, extends from the under side 4 of the stone to a distance from the upper edge 5 of the lateral face 6 of the single flags 2. The distance between the paving stones 1 can correspond to the distance between the single flags 2, and this width of joint can be ensured in the manner that there are e.g. at the outside of the stone 1 attached some concreted in spacing knobs, or there may be used catching grabs, the thickness of which corresponds to the width of the joint.

Figure 3:
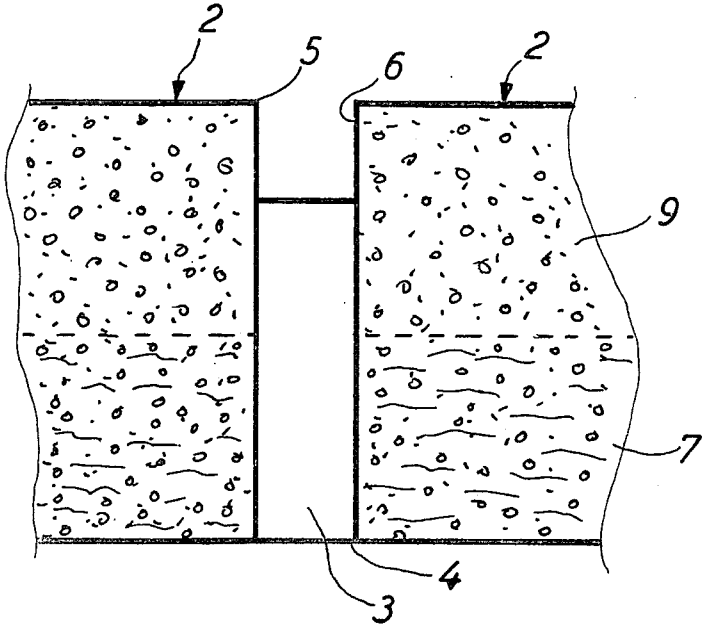
Figure 2:
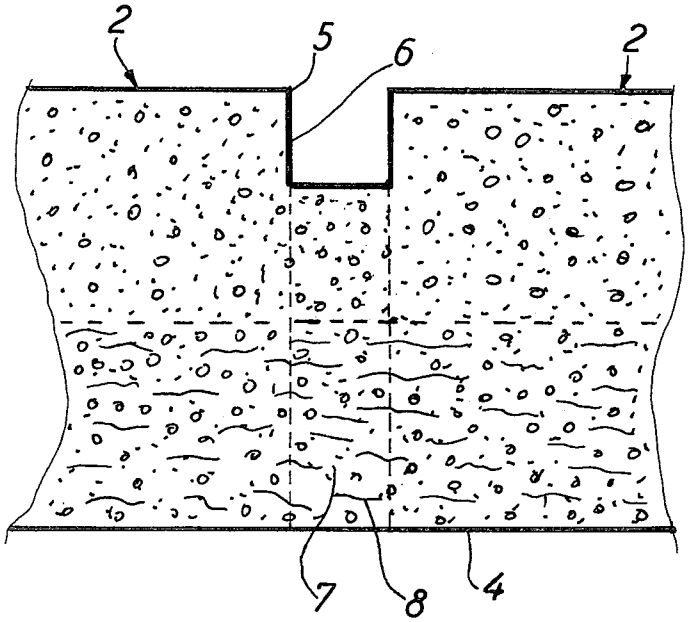

Each paving stone 1 is set at the bottom in reinforced concrete 7, as is shown in FIGS. 2 and 3. Hereby the lower part of the rib 3 will be reinforced for absorption of the tensile strains, which the stone 1 might be exposed to during lifts of the lateral edges. The remaining part 9 of the stone 1 only consists of ordinary concrete. Before laying of the paving-stones a bed of sand or gravel, the so-called sand bed, is to be levelled in a known manner. After this the single stones 1 are positioned in their places on the bed mainly by means of specially developed catching-, lifting and driving arrangements. After laying of all stones 1 the single flags 2 are vibrated in place, whereby the ribs 3 break. The cost of storage, transport and laying will be considerably reduced in proportion to manual laying of single stones. Experiments have proved that indeed up to 75% of the usual cost can be saved.

The method of manufacturing the paving stones will be described below. The stone can be concreted in a usual concreting machine, in which the form is provided with partitions, which by means of cutouts form and shape the connecting rib. In the first place concrete is poured, which is reinforced in such a manner that the tensile strength is sufficient. Then ordinary concrete is poured and a usual vibration is carried out, after which the stone is ready concreted and can be transported for setting and storage.

The reinforcement can in a preferred embodiment consist of pieces of braided artificial fibres of a length of about 5 cm. Other kinds of reinforcement materials may naturally be used such as cowhairs, steel fibres or the like. The reinforced concrete must only possess sufficient strength for keeping the stones together in case of premature breakings of ribs, if any.

I claim:

1. A concrete paving-stone comprising a plurality of single flags and at least one rib between adjacent single flags, which rib extends from the underside of the stone to at most the upper edge of the lateral face of each single flag, said rib having a thickness less than that of the adjacent flags and being unitary therewith, the lower parts of the ribs and flags consisting of concrete with a reinforcement comprising fibers for increasing the tensile strength thereof, and for holding said flags together, the upper part of the rib consisting of concrete without any reinforcement, whereby said paving-stone is resistant to breaking by strains due to support thereof adjacent two spaced lateral edges during shipping; said ribs, upon application of vibration after installation, breaking to thereby result in individual flags.

2. A concrete paving-stone according to claim 1, wherein said fibers have a length on the order of 5 cm.

3. A method of manufacturing a concrete paving-stone according to claim 1 comprising mixing a quantity of concrete with short reinforcement fibrous materials, pouring the mixture into a concreting form with a form partition for single flags and ribs for forming single flags and ribs, pouring ordinary concrete into said mold to fill up said ribs, and vibrating the form to secure cohesion between the two layers of concrete.

* * * * *